United States Patent [19]

Babler

[11] Patent Number: 4,507,001

[45] Date of Patent: Mar. 26, 1985

[54] PRINT WHEEL MOUNTING

[75] Inventor: Egon S. Babler, Northbrook, Ill.

[73] Assignee: Xerox Corporation, Stamford, Conn.

[21] Appl. No.: 202,977

[22] Filed: Nov. 3, 1980

Related U.S. Application Data

[63] Continuation of Ser. No. 141,442, Apr. 18, 1980, abandoned.

[51] Int. Cl.[3] ..... B41J 1/30

[52] U.S. Cl. ..... 400/144.2; 400/175

[58] Field of Search ..... 400/144.2, 144.3, 175

[56] References Cited

U.S. PATENT DOCUMENTS

| | | | |
|---|---|---|---|
| 3,442,365 | 5/1969 | Ragland et al. | 197/53 |
| 3,907,091 | 9/1975 | Meier | 197/53 |
| 4,124,312 | 11/1978 | Johnson | 400/144.2 |
| 4,127,335 | 11/1978 | Bogert et al. | 400/144.2 |
| 4,198,169 | 4/1980 | Stuiber et al. | 400/144.2 |
| 4,209,262 | 6/1980 | Savage | 400/144.2 |

FOREIGN PATENT DOCUMENTS

| | | | |
|---|---|---|---|
| 2159261 | 8/1972 | Fed. Rep. of Germany | 400/144.2 |
| 2822313 | 12/1979 | Fed. Rep. of Germany . | |
| 2022022 | 12/1979 | United Kingdom . | |

*Primary Examiner*—Paul T. Sewell

*Attorney, Agent, or Firm*—Richard A. Tomlin

[57] ABSTRACT

An impact printer of the type wherein a print wheel is rotated to a print position by a motor, and printing is caused by impacting a particular character on the print wheel by a print hammer. The present impact printer has the print wheel drive means and the print hammer mechanism located on opposite faces of the print wheel, which greatly facilitates removal and insertion of print wheels in the printer.

3 Claims, 6 Drawing Figures

PRINT WHEEL MOUNTING

This application is a continuing application of application Ser. No. 141,442, filed Apr. 18, 1980, abandoned, in the U.S. Patent and Trademark Office.

On current impact printers utilizing a rotatable print wheel, such as used in the Xerox 800, Electronic Typing System a motor, hammer mechanism and ribbon cartridge are all supported on a frame, which frame is pivotally mounted on a moving carriage. The frame must be pivoted from a print position in order to replace the print wheel. Further, due to interfering structure, the ribbon cartridge must be removed to allow pivoting of the frame. It is desirable to replace the print wheel in the printer using as simple a mechanism as possible.

The invention as claimed is intended to provide such a simplified mechanism. It solves the problem of how to provide a print wheel that can be easily inserted into a printer and further allow the use of stiffer, more durable print wheels that need not be contained in a print wheel cartridge.

The advantages offered by the invention are that not only is the print wheel easy to load, but the mechanism for receiving the print wheel cartridge also automatically aligns the print wheel in the print wheel drive position. These benefits arise mainly from the drive motor for the print wheel being located on the face of the print wheel, opposite the face of the print wheel on which the print hammer mechanism operates.

One way of carrying out the invention is described in detail below with reference to the drawing, which illustrates only one specific embodiment, in which.

In each of the various Figures, the same or similar parts are given the same reference numerals for ease in understanding.

Figure 4:
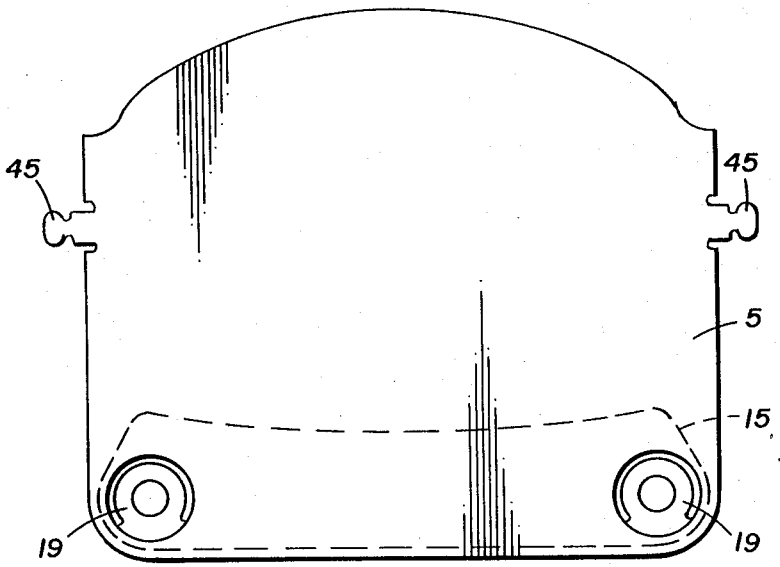
FIG. 4 is a plan view of the cartridge gate in accordance with this invention, which shows the spring plate bias member for the gate.
Figure 1:
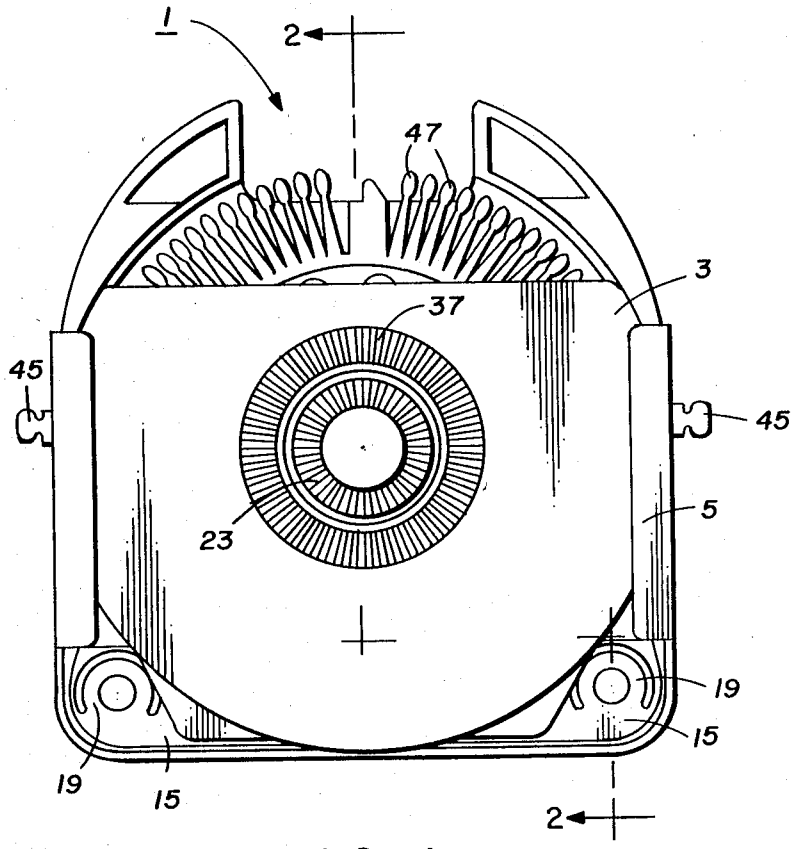
FIG. 1 is a plan view of a print wheel, print wheel cartridge and cartridge gate in accordance with this invention showing the print wheel drive face of the print wheel.
Figure 2:
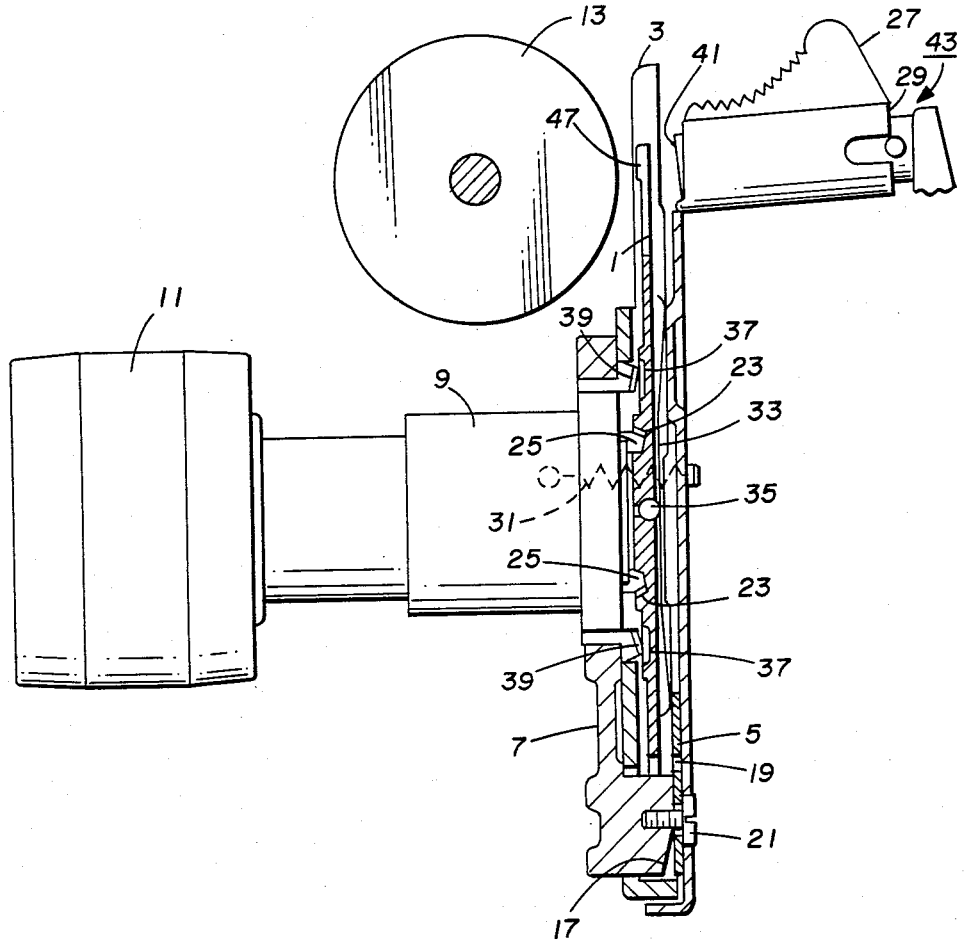
FIG. 2 is a partial sectional side view of a motor, drive shaft, print wheel drive element and connection thereof to a cartridge gate, the cartridge gate, print wheel and print wheel cartridge being shown in partial section as indicated by lines 2—2 in FIG. 1.

Referring now to FIGS. 1-4, there is seen a print wheel generally designated as 1 having print or type characters 47 thereon. This print wheel is described in copending patent application Ser. No. 141,446, filed in the U.S. Patent and Trademark Office on Apr. 18, 1980, and entitled "A Print Wheel With Self-Contained Means for Print Wheel Alignment", the disclosure of which is hereby incorporated herein by reference. Print wheel 1 is contained in print wheel cartridge generally designated 3. The print wheel 1 and print wheel cartridge 3 are a self-contained unit, which unit can be readily removed from and inserted into a print wheel gate generally designated 5. Print wheel gate 5 is pivotally mounted on print wheel drive motor flange generally designated as 7. Flange 7 is a part of drive shaft housing 9, which, in turn, is a part of print wheel drive motor 11. Print wheel drive motor 11 is mounted to a frame (not shown), which frame is mounted for axial movement relative to printer platen 13. A typical frame mounting is shown in U.S. Pat. No. 4,124,312, issued Nov. 7, 1978, to the assignee of this invention. The frame 12 is mounted on rails 10 for movement axial to platen 108 as shown in that patent.

Figure 3:
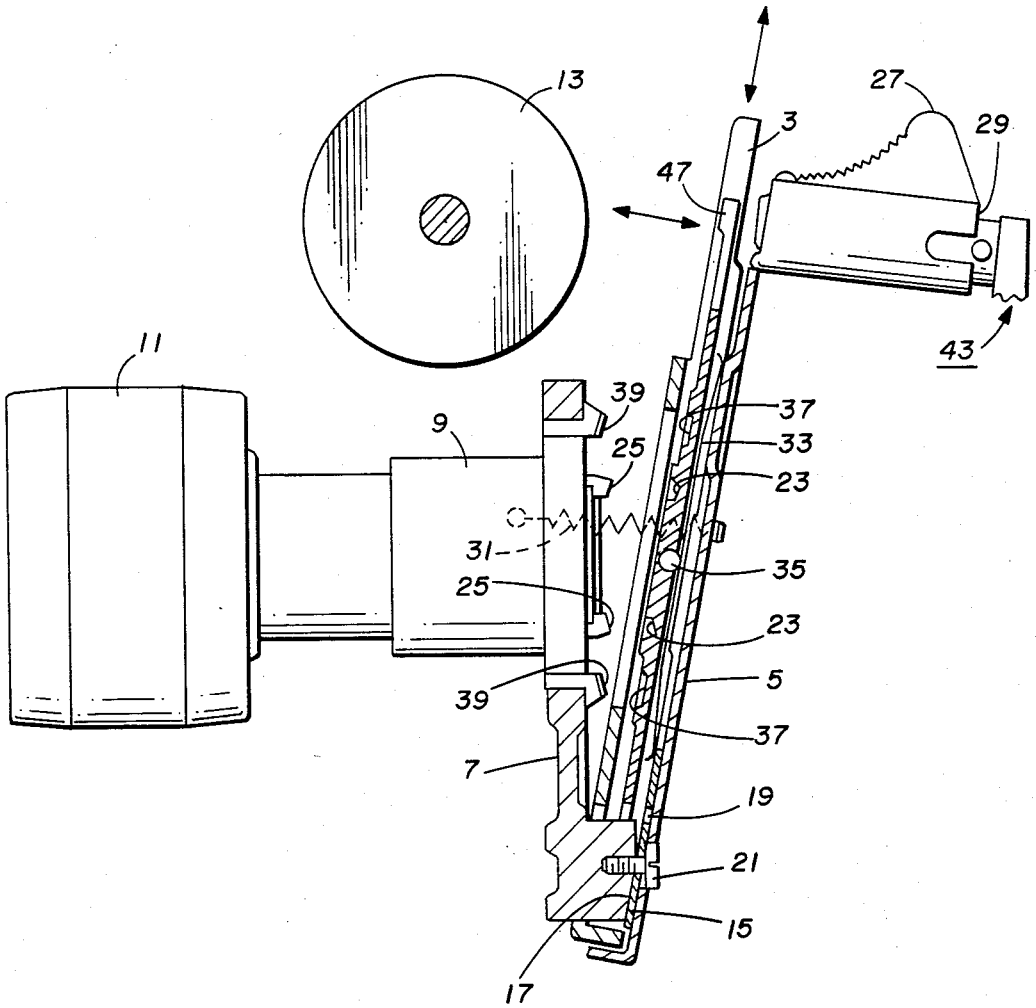
FIG. 3 is similar to FIG. 2 but showing the print wheel, print wheel cartridge and gate in the print wheel removal and insertion positions.

Print wheel gate 5 can be mounted for pivoting on flange 7 by means, for example, of flexible rubber-type bushings. Here, however, a spring steel plate 15 is attached to the inside of print wheel gate 5. Flange 7 has a beveled edge 17, which allows spring plate 15 to flex as shown in FIG. 3. Eyes 19 of spring plate 15 are held firmly against fixed alignment means by screws 21. Gate 5 is allowed to pivot by the flexing of spring plate 15. As gate 5 moves from the print wheel removal position of FIG. 3 to the print wheel drive position of FIG. 2, print wheel drive teeth 23 mesh with print wheel drive shaft teeth 25 mounted on the drive shaft (not shown) of motor 11. A grooved handle 27 is mounted on the hammer guide 29, which, in turn, is mounted on print wheel gate 5 for ease in pulling gate 5 away from the print wheel drive shaft teeth 25. Spring 31 clamps the print wheel cartridge 3 between the flange 7 and the gate 5. Spring mounting means 45 are provided on the print wheel gate 5 and on flange 7. Print wheel spring plate 33 pressing against ball 35 provides the pivot point around which print wheel 1 freely rotates. As described in detail in copending patent application Ser. No. 141,455, filed in the U.S. Patent and Trademark Office on Apr. 18, 1980, and entitled "Print Wheel Positioning Means", the disclosure of which is hereby incorporated by reference, when it is desired to print a character, print wheel drive shaft teeth 25 are pulled out of contact with print wheel teeth 23. Spring 33 acting against ball 35 urges print wheel registration teeth 37 into contact with fixed fine-alignment teeth 39. Hammer 41 is then driven by a hammer mechanism, shown generally as 43, to more characters 47 into contact with a type ribbon and paper (not shown) placed between print wheel 1 and platen 13.

It can be seen that, when print wheel gate 5 is in the print wheel removal position shown in FIG. 3, the print wheel cartridge 3 can be pulled straight out without concern for contacting any interfering structure. The advantages of this invention occur as a result of positioning print wheel drive motor 11 and drive shaft and drive shaft housing 9 on the side of print wheel 1, opposite the hammer mechanism 43. It is accordingly not necessary to pivot or move the print wheel drive apparatus with the print wheel to effect removal and insertion of a print wheel.

Figure 6:
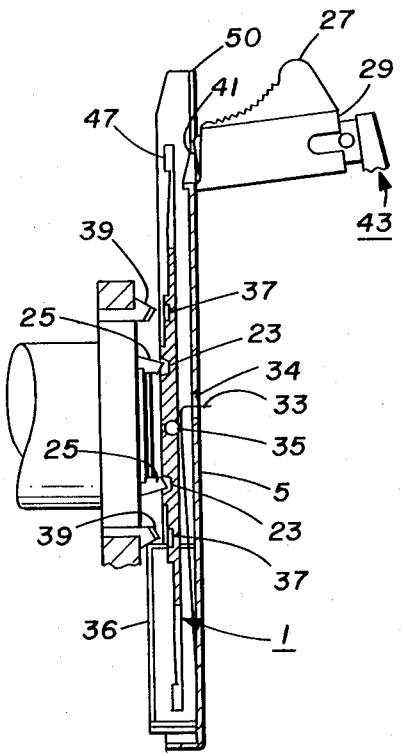
FIG. 6 shows a partial sectional side view of the gate of FIG. 5 with the print wheel located in the gate in the print wheel drive position.
Figure 5:
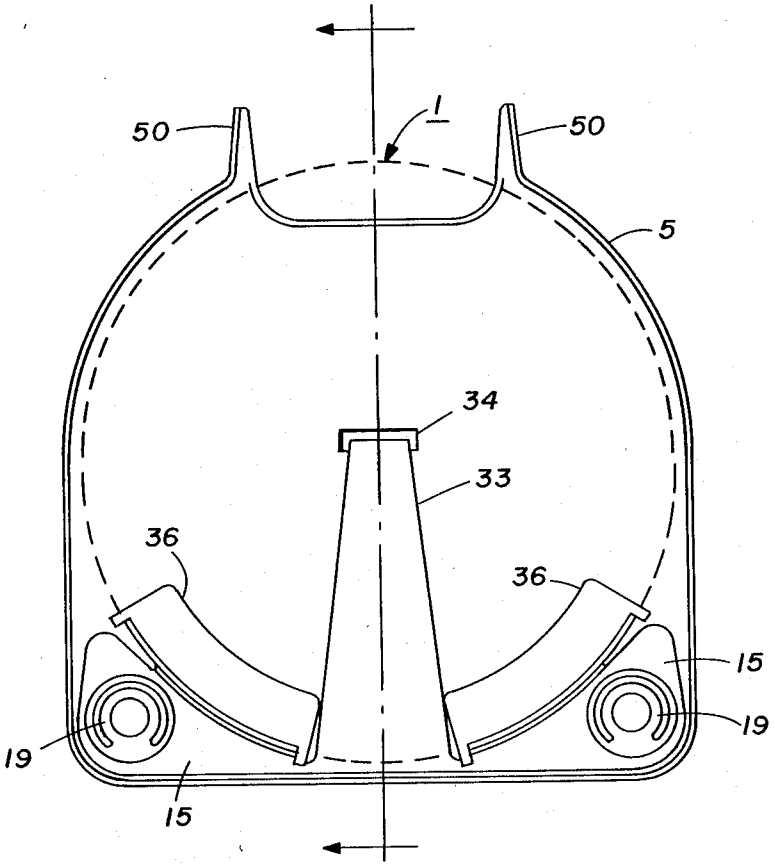
FIG. 5 shows a gate that can be used to accommodate a print wheel not contained in a cartridge with the location of the print wheel indicated by the broken line circle.

It can be seen that, because of the axial displacement of the print wheel 1 towards platen 13 when engaging the fine-alignment teeth 39, the print wheel 1 can be positioned closer to platen 13, allowing shorter, stiffer, hence more durable print wheels to be used. It is thus possible to provide print wheels that need not be protected by print wheel cartridges. The gate 5 shown in FIGS. 5 and 6 provides the functions of the gate 5 shown in FIGS. 3 and 4 and of the print wheel cartridge 3. Gate 5 in FIGS. 5 and 6 has two guides 36 that support the print wheel 1. Print wheel 1 is shown as the broken circle 1 in FIG. 5. The print wheel 1 is dropped into the gate 5, while gate 5 is open. As the gate is closed, spring 33 on gate 5 urges, through pivot ball 35, print wheel teeth 23 into contact with drive shaft teeth 25. Print wheel 1 is thereby centered so that it can rotate freely within the gate 5 as shown in FIG. 6. Slot 34 allows movement of spring 33 when drive shaft teeth 25 are pushed against print wheel drive teeth 23 to drive print wheel 1 to a typing position. Also ribbon guide members 50 are provided on the gate 5. Gate 5 is mounted for pivoting on spring steel plate 15 as described in connection with FIGS. 1–4.

While the principles of the invention have been made clear in the illustrative embodiments, there will be many modifications in structure, arrangement, proportions, etc., that will occur to those skilled in the art. The appended claims are, therefore, intended to cover and embrace any such modifications within the scope and spirit of the invention.

What is claimed is:

1. A mounting and drive apparatus for an impact printer print wheel which comprises:

(a) print wheel drive means for releasably engaging a print wheel, said drive means including a drive means flange;

(b) hammer means positioned such that, when activated, the hammer means will cause preselected type characters on the print wheel to move toward a platen;

(c) a print wheel gate pivotably mounted on said drive means flange such that a print wheel contained in said print wheel gate can be pivoted with said print wheel gate from a load/unload position to a print wheel drive position where a face of the print wheel is releasably, driveably engaged with said print wheel drive means, said print wheel gate being positioned between said print wheel drive means and said hammer means, said drive means being located on the same side of said print wheel gate means as the platen, and said hammer means is connected to said print wheel gate means for pivotal motion therewith.

2. The print wheel mounting and drive apparatus of claim 1 in which said print wheel gate is adapted to contain a print wheel cartridge.

3. The print wheel mounting and drive apparatus of claim 1 wherein said print wheel gate is adapted to contain a print wheel, and said gate further includes bias means for biasing a print wheel contained therein toward said print wheel drive means.

* * * * *